US009261342B2

(12) United States Patent
Albakri et al.

(10) Patent No.: US 9,261,342 B2
(45) Date of Patent: Feb. 16, 2016

(54) ROCK AND CONCRETE BREAKING (DEMOLITION—FRACTURING—SPLITTING) SYSTEM

(76) Inventors: Sami Abdulrahman A. Albakri, Jaddah (SA); Yusuf Vasfi Ozalp, Ankara (TR)

( * ) Notice: Subject to any disclaimer, the term of this patent is extended or adjusted under 35 U.S.C. 154(b) by 319 days.

(21) Appl. No.: 13/992,761

(22) PCT Filed: Dec. 17, 2010

(86) PCT No.: PCT/TR2010/000249

§ 371 (c)(1),
(2), (4) Date: Jul. 11, 2013

(87) PCT Pub. No.: WO2012/082084

PCT Pub. Date: Jun. 21, 2012

(65) Prior Publication Data

US 2015/0040788 A1 Feb. 12, 2015

(51) Int. Cl.

| | |
|---|---|
| ***C06B 29/00*** | (2006.01) |
| ***C06B 33/06*** | (2006.01) |
| ***F42D 1/045*** | (2006.01) |
| ***C06B 29/02*** | (2006.01) |
| ***F42B 3/04*** | (2006.01) |

(Continued)

(52) U.S. Cl.

CPC . *F42D 3/04* (2013.01); *C06B 29/00* (2013.01); *C06B 29/02* (2013.01); *C06B 33/06* (2013.01); *F42D 1/045* (2013.01); *F42D 1/14* (2013.01)

(58) Field of Classification Search

CPC ..... F42D 1/045; F42D 1/05; F42D 1/04; F42D 1/00; F42D 3/04; F42D 3/00; F42D 1/14; C06B 29/00; C06B 29/02; C06B 33/00; C06B 33/06

USPC ..... 102/301, 311, 312, 313, 200, 202, 102/202.5, 205

See application file for complete search history.

(56) References Cited

U.S. PATENT DOCUMENTS 3,862,866 A * 1/1975 Timmerman et al. ..... 149/21
5,773,750 A * 6/1998 Jae et al. ..... 102/302

(Continued)

FOREIGN PATENT DOCUMENTS

EP 1306642 A2 * 5/2003
EP 1308430 A2 * 5/2003

(Continued)

*Primary Examiner* — James S Bergin
(74) *Attorney, Agent, or Firm* — Gokalp Bayramoglu

(57) ABSTRACT

This invention is related to a controlled expanding chemical (CEC) and its activation system. In this invention the mixture of chemicals activated by a totally electronic/electrical system to break (fracture-demolish-split) rock and concrete and hard formations; without creating any shock waves, fly-rock, vibrations and without producing hazardous gases and having no damage or harm for human and living things comprises chlorates selected from magnesium chlorate, sodium chlorate, barium chlorate, potassium chlorate as alone or mixture of two or more with ratio of 30-70% by weight of mixture, oxalates selected from calcium oxalate, ferrous oxalate, lithium oxalate, potassium oxalate, sodium oxalate, ammonium oxalate, ferric ammonium oxalate, ferric sodium oxalate, ferric potassium oxalate as alone or mixture of two or more with ratio of 5-35% by weight of mixture, sugar or lactose or starch or any combination of them with ratio of 10-40% by weight of mixture, boron oxide (boroxide) (B2O3) with ratio of 2-25% by weight of mixture, and borax decahydrate (Na2B4O7.10H2O) with ratio of 1-20% by weight of mixture.

6 Claims, 7 Drawing Sheets

Figure 1:
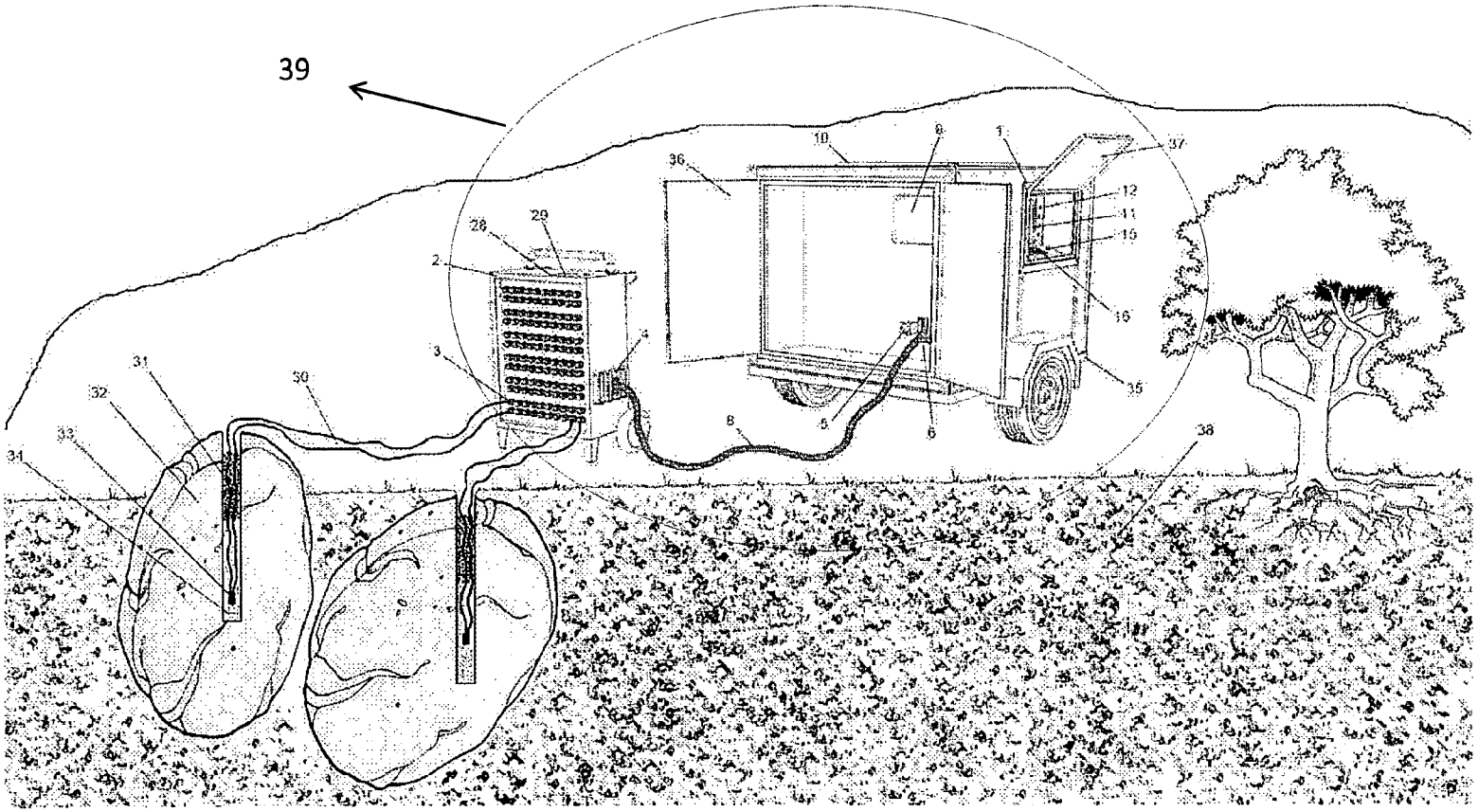

(51) Int. Cl.
*F42D 3/04* (2006.01)
*F42D 1/14* (2006.01)

(56) References Cited

U.S. PATENT DOCUMENTS 8,205,947 B2 * 6/2012 Morrison ..... 299/13
2003/0075068 A1 * 4/2003 Kim ..... 102/202.5
2003/0084753 A1 * 5/2003 Kim ..... 75/252
2003/0145924 A1 * 8/2003 Carter, Jr. ..... 149/37
2007/0107820 A1 * 5/2007 Schmidt et al. ..... 149/38

FOREIGN PATENT DOCUMENTS

GB 2341917 A * 3/2000
WO WO 2007092495 A2 * 8/2007

* cited by examiner

ROCK AND CONCRETE BREAKING (DEMOLITION—FRACTURING—SPLITTING) SYSTEM

TECHNICAL FIELD OF INVENTION

This invention is related to a controlled expanding chemical (CEC) and its activation system. In this invention the mixture of chemicals activated by a totally electronic/electrical system to break (fracture-demolish-split) rock and concrete and hard formations; without creating any shock waves, fly-rock, vibrations and without producing hazardous gases and having no damage or harm for human and living things.

The present invention can be used for fields of construction, mining, excavation, etc.; and all others where there will be a need of breaking rock, or concrete or in short all hard formations/structures.

The invention is designed and developed for the fields of:

road construction
excavation at housing sites
bridge demolition and renovation
mass excavation of rock
dimension stone quarries
boulder breaking
trenching in rock & hard materials
tunneling and shaft sinking
underwater excavation of rock and concrete
concrete and reinforced concrete breaking and demolition
blocked and clogged silo cleaning and rathole opening
interior demolition of rock and concrete
breaking—demolition and excavation of all types of hard formations and structures
excavation of all types of ground and soil and earth structures.

STATE OF THE ART

Prior Art

In the state of art there are several techniques for breaking (fracturing-demolishing-splitting) rocks or concrete structures or hard formations. Those are explained below.

1. Expanding Grouts:

Expanding Grouts are mixtures of certain chemical compounds, used to crack rock or concrete without any shock waves or vibrations. These products are used with water added at certain proportion and mixed to obtain a mortar like substance, which are then poured into the holes drilled.

These grouts are basically the mixtures of oxides, such as; calcium, silicon, aluminum, etc. and are composition of inorganic and organic compounds. The basic differences and weaknesses against our system can be given as follows:

the breaking pressure is at a level of 600-1000 kg/cm2, which very low when compared to ours; which is min. 4000-5000 kg/cm2.
the breaking action takes after a considerable time (about 10-20 hours), as the expansion reaction is very slow.
The water ratio in the mixture is important to avoid any sort of failure of the product.
The distances between holes are very close (in between 15-60 cm.) to obtain better results. Thus, application requires many holes with a limited hole lengths.
It is not an economical product when amount per hole is considered. An efficient rock breaking pattern requires extremely high amount of expanding grout that increases the cost to break rock or concrete very much.

It is not practical to use such a product in a series of applications to break huge amount of rock.

2. Pyrotechnical Rock Breaking Products:

Pyrotechnical Rock Breaking products are the ones; chemical mixtures of some compounds (nitrate based chemicals and/or peroxides) placed in a cartridge, using nitrocellulose propellent or fuses or detonators for ignition to activate the system. They are generally defined under the UN No. of 0432 (pyrotechnical goods for technical purposes) and 1.4 S (dangerous goods class/small arms ammunition).

They generally require special certification and permission for importation, transport, usage and storage in many countries and again require the permission of local authorities for usage. The basic differences and weaknesses against our system can be given as follows:

Even though they are designed to be considered out of explosives regulations, due to their contents and methods of ignitions, they are still treated under the explosives regulations with the definitions of pyrotechnical goods, during all stages of operations, in very many countries.
The usage is limited with the cartridge dimensions, in terms of hole depth and diameter.
The nitrate based compounds used in the mixtures is risky when the usage of such goods (like fertilisers) for terrorism.
Units to be used at a time are limited with the igniters, cartridge sizes, etc. used.

3. Rapid Expansive Metals:

These are rock breaking cartridges in which some metals are placed (like; Al, CuO, . . . ), converted into a plasma received from a very high voltage source and/or specially designed detonators; ending with a pressure to break rock and concrete. The basic differences and weaknesses against our system can be given as follows:

Due to the usage of some metals that to be considered as the raw materials of explosives and usage of detonators in which there is pyrotechnical products, in many countries; these products require special permission for all stages of usage from local authorities.
These products are generally expensive thus, increase the cost of rock excavation.
The breaking capacities are relatively very low as compared to our system (1:5)
The usage is limited with the cartridge dimensions, in terms of hole depth and diameter.
Units to be used at a time is limited with their ignition systems; (i.e.; 12-15 per igniter/shot).

4. Rock-Crackers:

The Rock Cracker is a non-explosive rock-splitting tool which makes use of the technology of motive force. A device filled with a motive medium cartridge generates a pressure impulse in the device. The pressure impulse is transmitted by means of a path into an incompressible fluid column (water of gel) situated in a pre-drilled hole in the rock. The basic differences and weaknesses against our system can be given as follows:

Initially, it should be indicated that the cartridge used is the one similar to the one used for rifles. Thus, it requires permission/certification to import and use it. In many countries, it is under license and special permission to carry out all these operations.
The product is limited to be used only for boulders or sectional concrete blocks.
The tool used to break rock limits the volumes to be broken. Thus, it has very low capacity.
It is a very expensive system to break.

It requires a secondary medium to transfer its pressure; basically water filled in holes. If there is even a tiny crack, water runs away and the system cannot work.

It is not possible to activate many holes at a time due to its application principles.

5. Hydraulic Rock Splitters:

These are mechanical systems, aimed to break rock and concrete with the power of hydraulic pressure. Basically, the system works with the pushing power of steel elements (pistons or wedges), placed into the drilled holes, which is generated by the hydraulic power. The basic differences and weaknesses against our system can be given as follows:

Being a mechanical system, they are not directly compared with our technology.

There is always a risk of mechanical failure or squizzing of pistiosn/wedges in the rock that will end with the stopping of the breaking operation.

Requires, too many holes per unit volume, thus not efficient.

Preferably used for secondary breaking (boulders, broken concrete, etc.)

Too many accessories and equipment to carry and move from place to place.

Relatively expensive in terms cost per unit volume as compared to our system.

6. Hydraulic Rock Breakers:

These are mechanical tools used basically in cooperation with excavators, attached to the end of the booms. The hydraulic power created is transferred into a mechanical impact force and the breaking pressure obtained can break rock and concrete. The basic differences and weaknesses against our system can be given as follows:

Being mechanical systems; create a continuous damage on the system and the machine it is attached.

It is an expensive method of breaking rock and concrete (indirect costs arising from operator skill, excavator breakdown costs, the damaging and exchange of breaking tips, etc.).

Breaking capacity is low as compared to all other chemical technologies.

Create high and continuous noise during breaking; thus, generally irritating inside the cities.

7. Hand-Held Rock Breakers:

These are small tools; air, fuel or electric operated. Basically are for small jobs to break rock and concrete. Each requires an operator. Being mechanical equipment, they fail and get broken frequently. The basic differences and weaknesses against our system can be given as follows:

Being mechanical systems, create a continuous damage on the system and the machine it is attached.

It is an expensive method of breaking rock and concrete (indirect costs arising from operator skill, breakdown costs, the damaging and exchange of breaking tips, etc.).

Breaking capacity is very low as compared to all other chemical technologies.

8. Explosives:

An explosive material, also called an explosive, is a substance that contains a great amount of stored energy that can produce an explosion, a sudden expansion of the material after initiation, usually accompanied by the production of light, heat, sound, and pressure. An explosive charge is a measured quantity of explosive material An explosion is a type of spontaneous chemical reaction (once initiated) that is driven by both a highly negative enthalpy change (much heat is released) and a highly positive entropy change (large quantities of gases are released) in going from reactants to products, thereby constituting a very thermodynamically favorable process in addition to one that is kinetically very fast.

The production facilities are built with the highest care to avoid any sort of accident and hazard. Besides, these factories have to be in the land quiet away from housings, etc. The basic differences and weaknesses against our system can be given as follows:

Explosives are under the most critical definitions for transport, storage, usage, etc., given by UN, IATA, and other similar international organizations.

Almost all explosives are not allowed to be transported by air freight. All other means of transport requirei special precautions and permissions.

Explosives are generally sensitive to heat, friction, impact, pressure; one or combination of these may easily lead to an explosion.

Most of them are very toxic and even produce toxic gases after usage.

Some examples of explosives are; nitroglycerin, TNT, nitrate based compounds, Anfo (ammonium nitrate & diesel fuel), nitrocellulose, RDX, etc.

Explosives are initiated using detonators, which have certain amount of explosive materials in compositions.

The velocity of detonation (VOD) and impact pressure of explosives are very high and easily becomes very dangerous for the human and environment (VOD; 1500-9000 m/sec./Pressures at hundreds of atm·s).

It is almost impossible to use explosives inside cities and suburb areas.

In todays world, explosives are headaches (in terms of storage, transport, etc.) when worldwide terrorism is considered.

The Technical Problem Aimed to Solve, and the Aims of the Invention

The main aim of this invention is to develop a "rock and concrete breaking (demolition-fracturing-splitting) system" without creating any shock waves, fly-rock, vibrations and without producing hazardous gases and having no damage or harm for human and living things.

The basic properties of the "rock and concrete breaking (demolition-fracturing-splitting) system" developed by this invention are below;

With this invention; the result of having a total system and technology is reached;

The technology (system developed by this invention) is totally free from any regulation or restriction during production-transport-usage; those restrictions/regulations especially valid for all types of explosives, pyrotechnical products, fire-works, etc. . . . and even fertilizers.

Non of the components, parts, compositions face any regulation or restriction that they are dangerous goods like; explosives, pyrotechnical products, fire-works, etc.

Breaking rock and concrete becomes very safe and easy.

All components, parts, equipment, attachments, etc. taking part in the system developed by present invention are free from any sort of strict regulation or limitation.

All components and parts of the system developed by present invention are free from any regulation, our product does not require any permission or license to use, transport and store.

It is so simple and easy to learn and use the system developed by present invention such that; a non-educated person can be trained in a couple of hours, to get to know how to use our product.

There are no shock waves and fly rock, negligible level of vibration.

No danger for environment during transport, storage and usage.

The results are attained rapidly; in a couple of milliseconds time, ending up with a broken and demolished rock or concrete.

There is not any danger;

under pressure . . . material gets compacted under impact . . . material just spills off under fire . . . material just burns and fades away under voltage . . . material shows no reaction; means not conductive in contact with water . . . decomposes and loses all its specifications in contact with oil . . . decomposes and loses all its specifications in contact with petroleum . . . decomposes and just burns and fades away It is a very economical system almost for all types of rock and concrete demolition jobs. the economy comes not only from the product but also indirectly; due to its' being very simple, practical and flexible.

It is a tailor made product, depending on the application parameters, the required mixture to be used in the system can be produced in very many sizes both in diameters and lengths and basically in bulk form; just ready to be poured into the holes prepared.

Depending on the requirement, one can place sufficient amount of mixture of the system in each hole to increase the capacity.

The product can even be prepared at site considering the requirements.

The activation system which is a part of the present invention is capable of controlling very high number of points (say; 3000) to activate the holes at the same time. Thus; the production volume is relatively high (approx.; 8000-10000 m3), in a day.

The activation system is unique of its own, it can be defined as an "automatic control system at jobsite"; by which it is easy to program, define and set all holes according to the excavation program.

Sound levels are kept in the level of 60-75 db (decibel) as maximum. Meanwhile, the important argument about the sound level is; whatever the sound level could be (max. 80 dba), the maximum duration of peak sound is 50 msec. Thus, has no continuing effect on human ears.

The system developed by the present invention can be defined as "a rock breaking technology you can carry in your luggage".

It is impossible to use the system developed by this invention other than its main functions; under defined constraints, which are; correct size of holes (in dia. and length), sufficient stemming with a suitable material (clay, mud, lime, soil, cement, etc.), and enough and correct power and/or energy to start burning to activate the selected mixture. In all cases other than these parameters and even for the insufficient preparation of one of these, the system cannot work. In connection to above, we can declare and confirm that; our product cannot be used for any sort of terrorist activity.

Once the activation is completed, there is no risk left as all activated mixture become "off", even if you could not get any broken rock out of those shots.

DEFINITION OF FIGURES

In order to explain the present invention, figures have been prepared and attached to the description. The list and definition of the figures are given below.

FIG. 1—General assembly of the system

Figure 2:
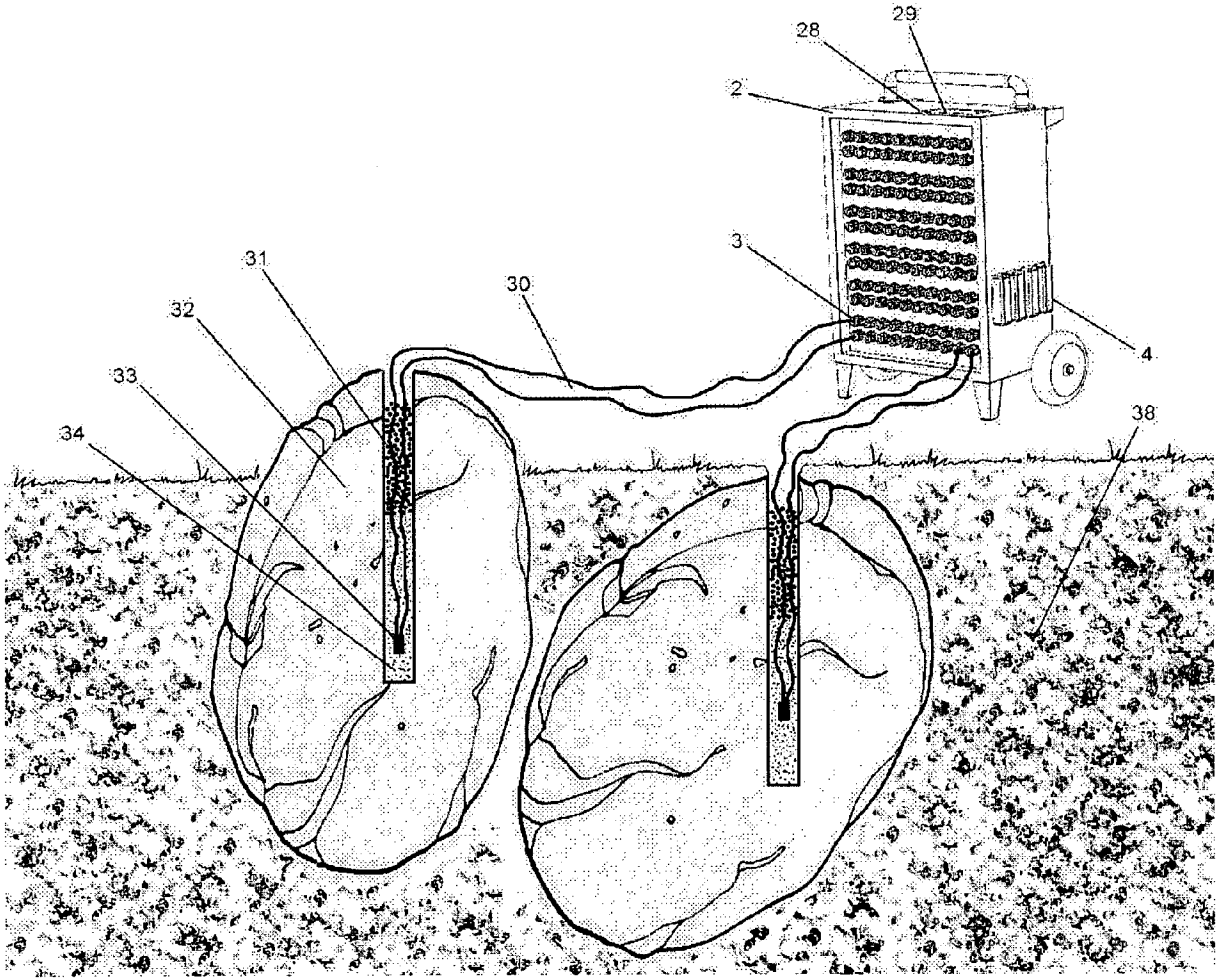
Figure 3:
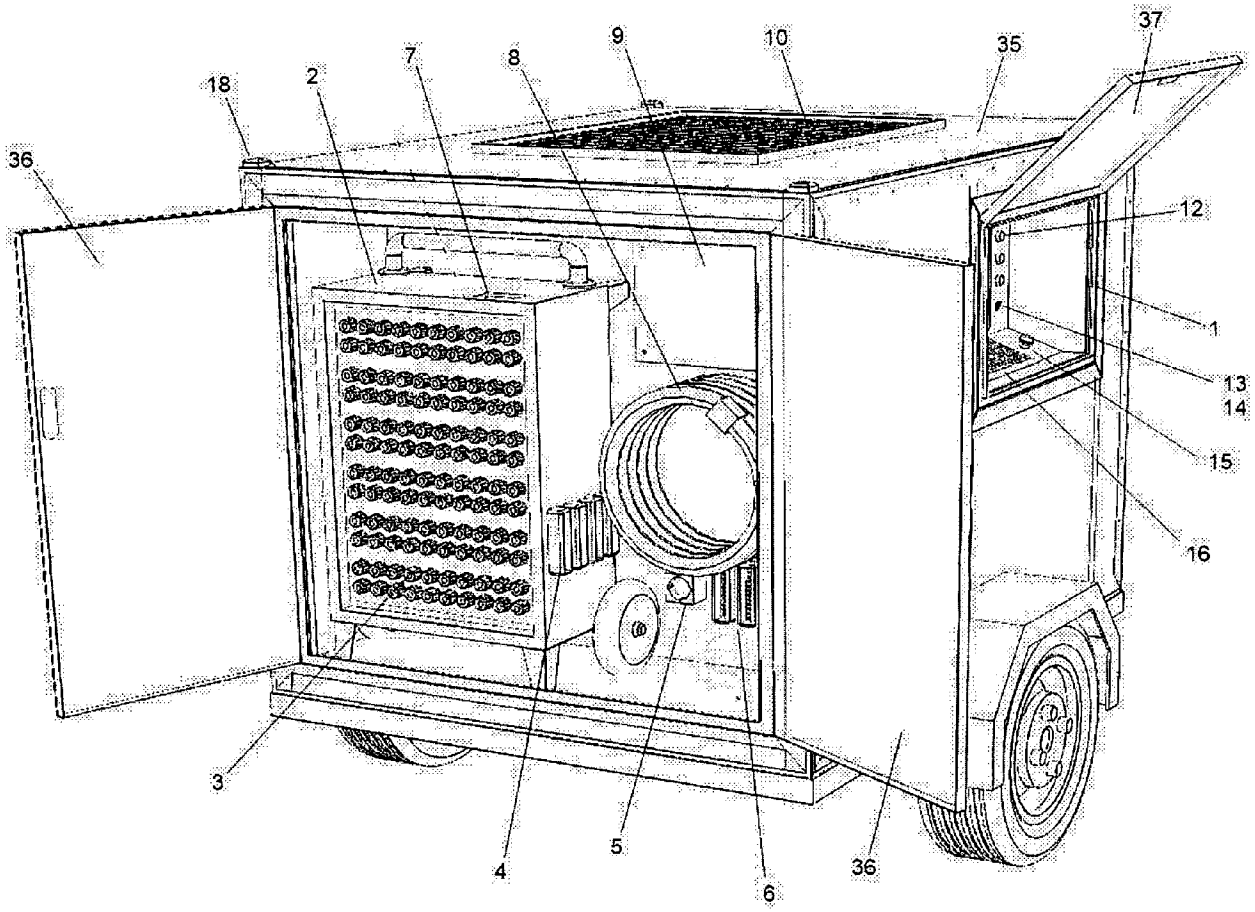
Figure 4:
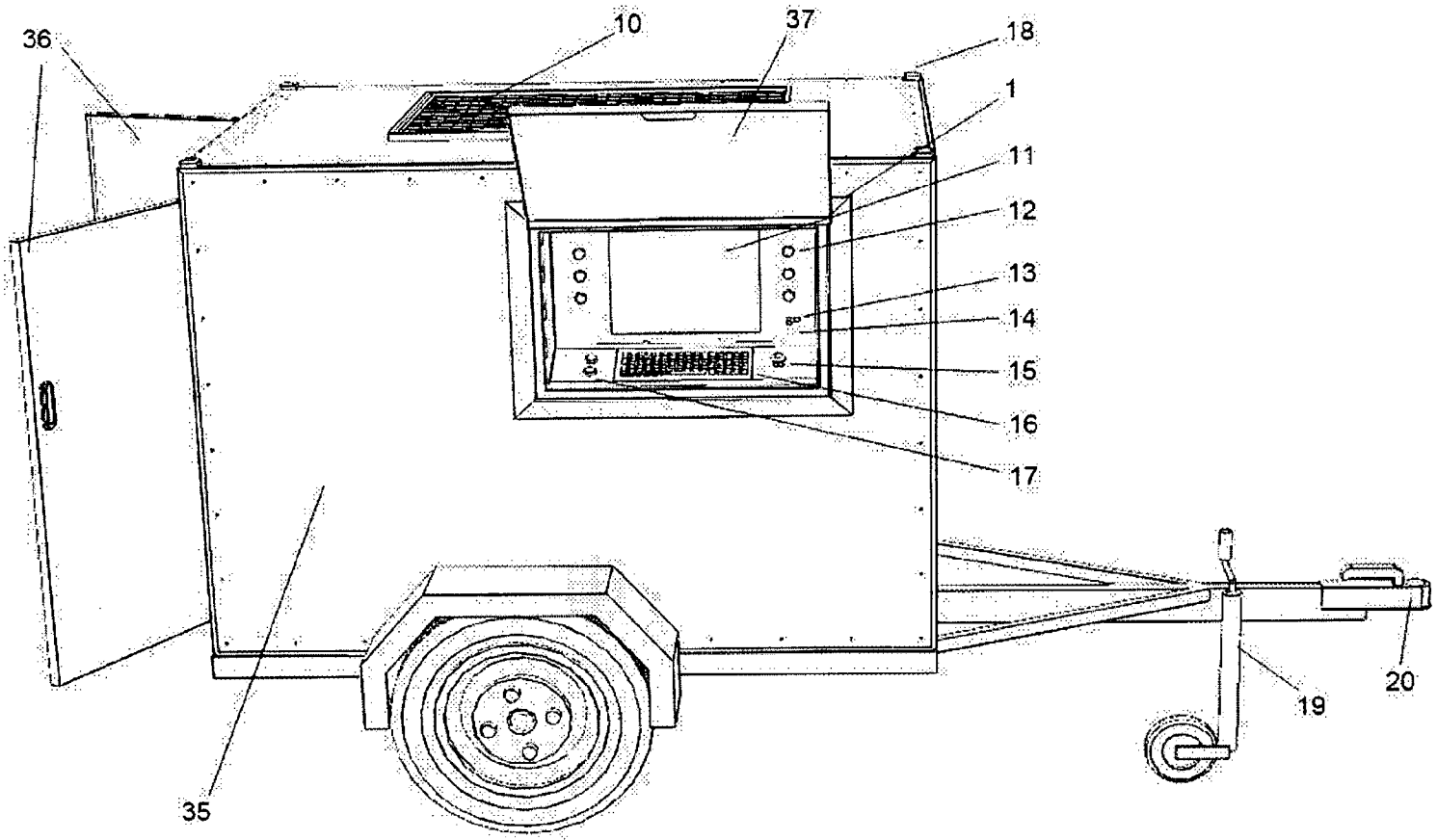
Figure 5:
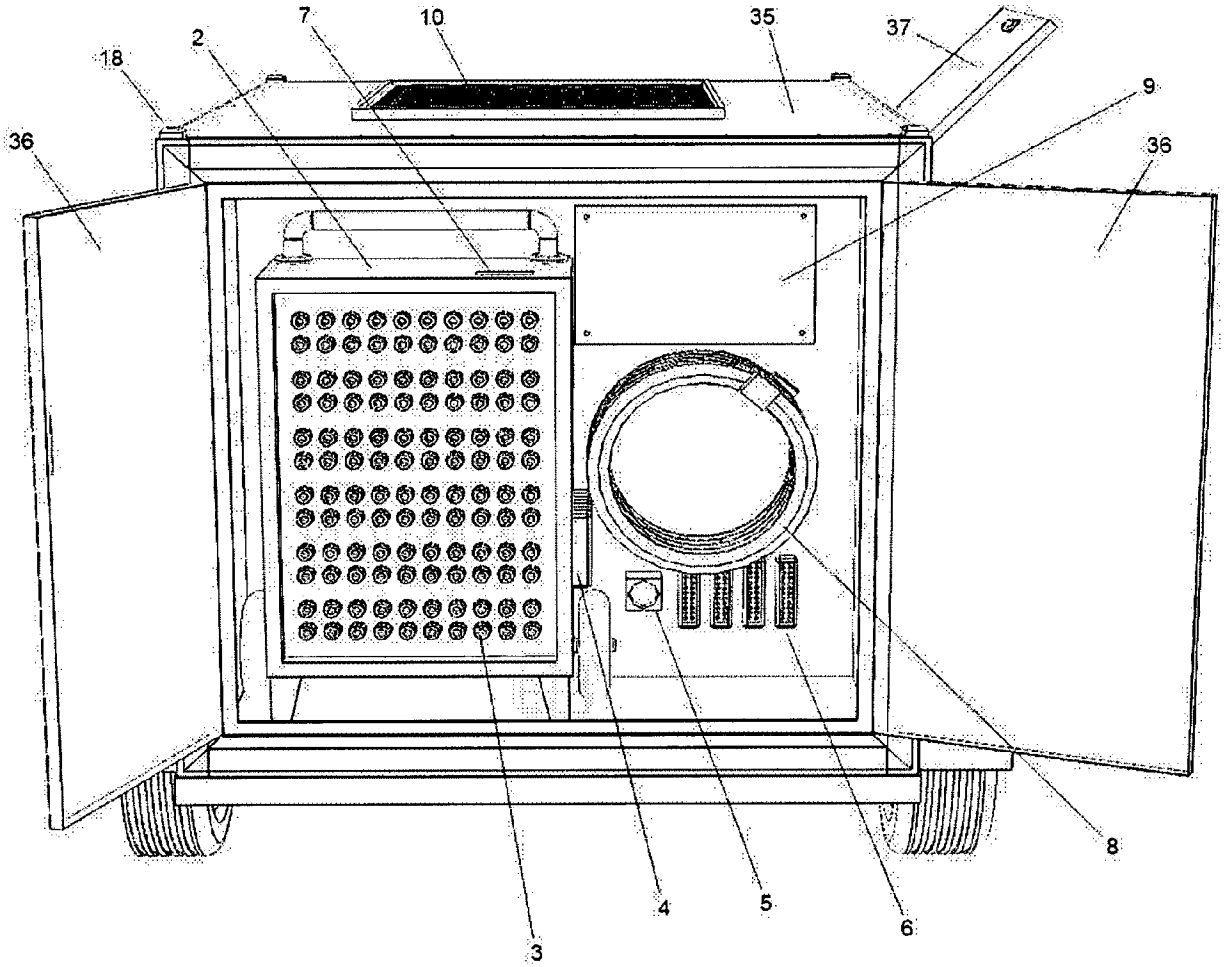
Figure 6:
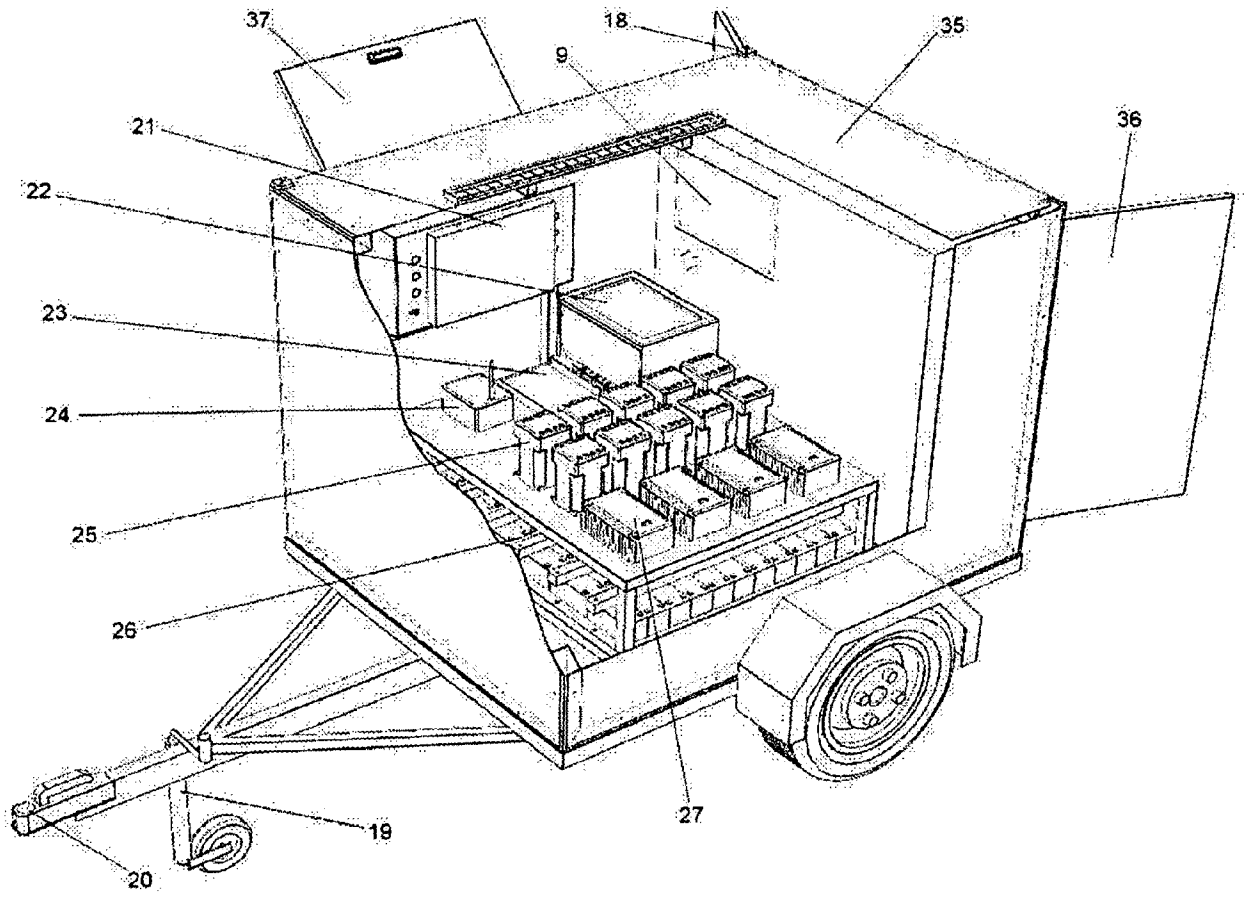
Figure 7:
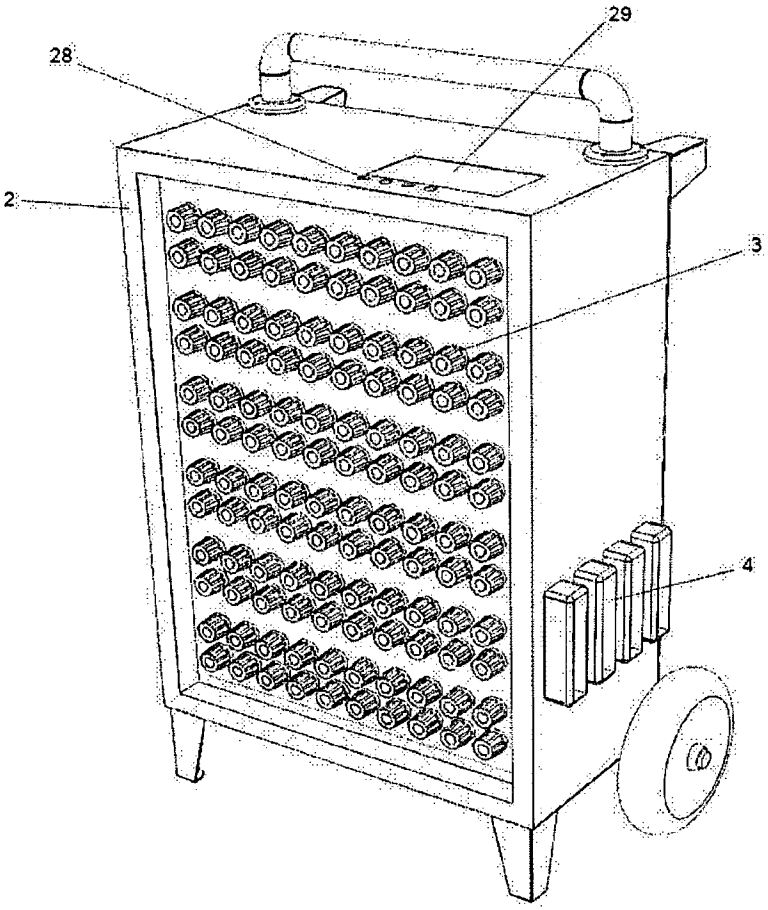

FIG. 2—General assembly of the mobile unit, chemical mixture and activation components FIG. 3—Assembled view of main unit and mobile unit FIG. 4—Side view of main unit showing control panel FIG. 5—Back view of main unit with mobile unit attached FIG. 6—Inside view of main unit FIG. 7—view of mobile unit

DEFINITION OF FEATURES SHOWN IN THE FIGURES

In order to explain the present invention the features in the figures have been numbered and the definition or the numbers are given below.

1—Main Unit Control Panel
2—Mobile Unit
3—Connectors for Activation components
4—Mobile Unit Connection Socket
5—Line Power Connector
6—Main Unit Connection Socket
7—Mobile Unit Control Panel
8—Connection cable; Main Unit to Mobile Units
9—Service Box (Fuse, Breakers, Power Drivers)
10—Solar Panel
11—Main Unit Control Panel Display
12—Navigation Buttons
13—USB Socket
14—Ethernet Socket
15—Emergency Button
16—Keypad
17—Activation Buttons
18—Places for Transport Hooks
19—Parking wheel
20—Trailer Hitch
21—Computer
22—External Power Supply
23—Charge Unit
24—Telecommunication Unit
25—Circuit Breakers
26—Batteries
27—Main Control Unit
28—Mobil Unit Control Buttons
29—Mini Control Panel and Display
30—Activation component wires
31—Stemming
32—Rock
33—Activation component
34—Chemical mixture
35—Main Unit
36—Mobile Unit Cabinet Door
37—Control Panel Cabinet Door
38—Ground
39—Activation System

BRIEF EXPLANATION OF THE INVENTION

The rock and concrete breaking (demolition-fracturing-splitting) system developed by this invention can be described/explained in 3 parts:

Part (A)—Chemical mixture (34)

Part (B)—Activation component (33) to be placed inside and/or in contact directly or indirectly with the chemical mixture (34)

Part (C)—Activation system (39) (mobile units (2), main unit (35)) with all hardware, software and related details.

Part (A)—Chemical Mixture (34)

Chemical mixture (34) is the core section of the invention. The chemical mixture (34) can be used in several forms such as;

in bulk form; to be poured directly into the holes, in bulk form; pressed [under any type of press, as a dry mixture and/or mixed with some other non-explosive chemicals (liquid or solid) and/or mixed with water (as liquid or vapor form) and/or mixed with some adhesives/glue and/or binders] and put into a cylindrical shape of different diameters and lengths (or other forms like; cube, sphere, prism, irregular shape, etc.). Additionally; can be shielded with several materials (like; silicon, rubber, plastic, etc.) to keep the pressed mixture in shape, as a cartridge; in which the chemical mixture (34) can be placed into a cartridge (any sort of plastic, PVC, wood, nylon or metal etc.).

as pellet form in different shapes and dimensions and sizes

The basic chemicals that make up the chemical mixture (34) are;

chlorates selected from magnesium chlorate, sodium chlorate, barium chlorate, potassium chlorate as alone or mixture of two or more, oxalates selected from calcium oxalate, ferrous oxalate, lithium oxalate, potassium oxalate, sodium oxalate, ammonium oxalate, ferric ammonium oxalate, ferric sodium oxalate, ferric potassium oxalate as alone or mixture of two or more, sugar or lactose or starch or any combination of them, boron oxide (boroxide) ($B_2O_3$), borax decahydrate ($Na_2B_4O_7.10H_2O$)

Besides, the chemical mixture (34) may further comprise any one or more of the followings;

boron and borax derivatives (such as; boric acid, borax pentahydrate, anhydraous borax, colemanite, ulexite, tincal, etc.)

ferrosilicon ($FeSi_2$)

silica based chemicals (such as amorphous silicate—$Si—O_2$)

The Mixture Ratios by weight (Formulation) for preparation of the chemical mixture (34) of the present invention rock and concrete breaking (demolition-fracturing-splitting) system are below:

chlorates selected from magnesium chlorate, sodium chlorate, barium chlorate, Potassium chlorate as alone or mixture of two or more, (30-70% by weight of mixture)

oxalates selected from calcium oxalate, ferrous oxalate, lithium oxalate, potassium oxalate, sodium oxalate, ammonium oxalate, ferric ammonium oxalate, ferric sodium oxalate, ferric potassium oxalate as alone or mixture of two or more, (5-35% by weight of mixture)

sugar or lactose or starch or any combination of them: (10-40% by weight of mixture)

boron oxide: (2-25% by weight of mixture)

borax decahydrate: (1-20% by weight of mixture)

boron and borax derivatives (such as; boric acid, borax pentahydrate, anhydraous borax, colemanite, ulexite, tincal, etc.) (0-25% by weight of mixture)

ferrosilicon: (0-20% by weight of mixture)

silica based chemicals (such as amorphous silicate) (0-5% by weight of mixture)

There are some basic preferred chemicals that make up the mixture. These chemicals are;

potassium chlorate ($KClO_3$), ammonium oxalate ($(COONH_4)_2.H_2O$)

sugar or lactose (in any particle size), ($C_{12}H_{22}O_{11}$/$C_{12}H_{22}O_{11}.H_2O$)

boron oxide (boroxide) ($B_2O_3$), borax decahydrate ($Na_2B_4O_7.10H_2O$)

Besides, additional chemicals are also valid for these mixtures which are;

ferrosilicon ($FeSi_2$)

silica based chemicals (such as amorphous silicate—$Si—O_2$)

Mixture Ratios by weight (Formulation) for preparation of the mixture of the present invention rock and concrete breaking (demolition-fracturing-splitting) system are below:

potassium chlorate: (30-70% by weight of mixture)

ammonium oxalate: (5-35% by weight of mixture)

sugar or lactose: (10-40% by weight of mixture)

boron oxide: (2-25% by weight of mixture)

borax decahydrate: (1-20% by weight of mixture)

ferrosilicon: (0-20% by weight of mixture)

Additionally silica based chemicals (such as amorphous silicate) (1-5% by weight of mixture) is added into the mixture to keep it dry and away from moisture.

In the mixture the preferred ratios of the components are below, potassium chlorate: 55-70% by weight of mixture ammonium oxalate: 15-25% by weight of mixture sugar or lactose: 15-30% by weight of mixture boron oxide: 10-25% by weight of mixture borax decahydrate: 2-10% by weight of mixture ferrosilicon: 0-5% by weight of mixture silica based chemicals (such as amorphous silicate): 1-3% by weight of mixture to keep it dry and away from moisture. If the mixture is waited for a long time the silica based chemicals (such as amorphous silicate) are added into the mixture.

The chemical mixture (34)s of this present invention can be activated by any conventional activation (ignition) elements such as electrical electronic or non-electrical detonators, flammable igniters.

There are several combinations of above chemicals from which we can obtain different energy levels that makes the product to break different rocks and concrete.

Some of these combinations can be given as below. The percentages are by weight (the ratio of weight of each component to the total weight);

The energy outputs for each sample below have been measured by the independent institute SAGE (Defense Industries Research and Development Institute). SAGE was established in 1972, and is active in three locations—METU Guidance Control Laboratory, Ankara Subsonic Wind Tunnel and Lalahan Site which is 30 km. away from the city center of Ankara, Turkey. The Institute is a part of TÜBİTAK (The Scientific and Technological Research Council of Turkey) and specializes in the field of defense industry.

The main function of SAGE is to perform research and development activities for defense systems including engineering and prototype production, starting with their fundamental research and conceptual design. Most of the projects are performed in coordination with related defense institutions.

SAGE believes international cooperation is as important as national partnerships and wishes to exchange knowledge with various partners from allied countries The range of activities that TÜBİTAK-SAGE performs can be listed as follows:

Guided and un-guided ammunition systems/subsystems;
execute development projects,
perform technology development studies,
accumulate know-how, form infrastructure and specialized work force,
Produce strategic system and subsystems,
Perform software development activities in areas of specialization (fire command and control, flight simulations, etc.),
Offer inspection and measurement services,
Offer consultancy services.

The abovementioned chemicals forming the mixture are not explosive. In order to determine and show this feature, the mixture has been tested under pressure, impact, voltage, fire and water by Department of Chemistry in the Middle East Technical University under the project number 08-01-03-515 dated 24 Jul. 2008. The report resulted that the mixture has no explosive characteristics under pressure, impact, voltage, fire and water.

Additionally the mixture has also been tested by sage to determine explosiveness under friction. The report has resulted that the mixture does not show any explosive characteristics under friction.

The tested samples are below. All the percentages of the samples are by weight of the mixture.

Sample-1)
potassium chlorate: 70%
ammonium oxalate: 9%
sugar or lactose: 8%
boron oxide: 3%
borax decahydrate: 2%
ferrosilicon: 8%
TOTAL: 100%
ENERGY OUTPUT: average: 478 cal/gr.

Sample-2)
potassium chlorate: 30%
ammonium oxalate: 20%
sugar or lactose: 20%
boron oxide: 10%
borax decahydrate: 5%
ferrosilicon: 15%
TOTAL: 100%
ENERGY OUTPUT: average: 363 cal/gr.

Sample-3)
potassium chlorate: 40%
ammonium oxalate: 15%
sugar or lactose: 15%
boron oxide: 10%
borax decahydrate: 5%
ferrosilicon: 15%
TOTAL: 100%
ENERGY OUTPUT: average: 493 cal/gr.

Sample-4)
potassium chlorate: 60%
ammonium oxalate: 10%
sugar or lactose: 10%
boron oxide: 3%
borax decahydrate: 2%
ferrosilicon: 15%
TOTAL: 100%
ENERGY OUTPUT: average: 522 cal/gr.

Sample-5)
potassium chlorate: 60%
ammonium oxalate: 16%
sugar or lactose: 16%
boron oxide: 5%
borax decahydrate: 3%
TOTAL: 100%
ENERGY OUTPUT: average: 731 cal/gr.

Sample-6)
potassium chlorate: 60%
sugar or lactose: 13.5%
boron oxide: 4%
borax decahydrate: 2.5%
ferrosilicon: 20%
TOTAL: 100%
ENERGY OUTPUT: average: 515 cal/gr.

Sample-7)
potassium chlorate: 65%
sugar or lactose: 20%
boron oxide: 10%
borax decahydrate: 5%
TOTAL: 100%
ENERGY OUTPUT: average: 674 cal/gr.

And some samples without any energy output test results can be given also as;

Sample-8)
potassium chlorate: 62.5%
sugar or lactose: 22.5%
boron oxide: 15%
TOTAL: 100%

Sample-9)
potassium chlorate: 60%
sugar or lactose: 20%
ammonium oxalate: 5%
boron oxide: 15%
TOTAL: 100%

NOTE: silica based chemicals (such as amorphous silicate) are added above these to keep the mixture dry and away from moisture.

All chlorates, oxalates, boron derivatives, sugar and lactose based products are in the scope of the invention.

Part (B)—Activation Component (33) to be Placed Inside the Chemical Mixture (34)

Activation component (33) is another necessary feature of the system to be used for activating the mixture to burn and expand rapidly. The types of activation component (33) are;

a) metal oxide based activation components
b) Silisium and/or Germanium based activation components
c) Diode and/or zener diode based activation components
d) Resistors based activation components
e) Cu, Al, Ag, Au, and/or Pt wire based activation components.
f) Capacitors (condensors) based activation components.
g) Composed of paper, wood materials with wire combination
h) Alternative types of activation components a) the Preferred Content of Activation Component (33) Contains Metal Oxides as the Main Substance.

It is possible to add the elements given below, the compounds that include these elements and/or solutions of these compounds inside the metal oxide compound. These elements are oxides of Bi, Ni, Co, Mn, Sb, Ag, B, Si, Al, In, Ga, Sn, Pt, Cr, Pd, Ti, La, Nd, Pr, Ce, Rh, Ba as alone or in combination and at least %90 by weight of the activation component (33).

The mixture that forms the activation component (33) covers minimum 90% (by wt.) metal oxide. Other substances that will take part inside the activation component (33) must be maximum 10% (by weight—wt).

Metal oxide alone can be used as the activation component (33).

Metal oxide activation component (33) can be mixture of Metal-Oxide with carbon.

If the activation component (33) will be used as a mixture, supplementary substances can be added between 0%-20%. (by wt.)

As the Activator Component (33), electronic components which contains metal oxide such as varistors (MOVs) and similar electronic components can be used.

Short circuit voltage of metal oxide based mixture can be in the range of 0.1 Volts-100 Volts AC or DC.

It is possible to add metal pins and/or shields that will be used as the soldering surface onto the metal oxide based activation components (33).

Activation components produced by these ways above can be used in the range of 0.1 V 100V voltage, and 100 μmA-50000 A current under AC or DC voltage.

b) if Metal Oxide is not Used as Activation Component (33), as an Alternative; Components Made Up of Silisium and/or Germanium can be Used.

Silisium and/or Germanium can be used by adding additional elements and/or compounds.

They can be mixed with Ruthenium, glass powder and cellulose type of materials.

Electronic components that contain Germanium and/or Silisium such as "diodes" can be used as activation component (33).

c) Diode and/or Zener Diode can be Used as Activation Component (33).

When diode and/or zener diode is used as Activation Component (33), breakdown voltage should be between 0.1 Volts and 100 Volts.

d) Resistors can be Used as the Activation Component

Resistor to be used can be used as activation component (33) by mixing with carbon and/or any compound containing carbon, with resin.

Resistor comprises Ni—Cr, Ni—Ag, Cu and/or any type compound or element.

When resistor is used as Activation component (33), resistor size is between 0 ohm and 1 Kohm.

Power of resistor is between 0 Watt and 100 Watts.

e) as an Activation Component (33) Cu, al, Ag, Au, and/or Pt Wire can be Used Alone.

Wire cross section can be between 0.1 $mm^2$ and 50 $mm^2$.

Components from 1 to 1000 can be connected in series and/or in parallel at the same time.

f) as an Activator Component Capacitors (Condensors) can be Used.

Capacitor voltage can be between 0.1 Volts and 500 Volts.

Capacity of the capacitor can be range of 1 nFarad and 1 Farad g) Composed of Paper, Wood Materials and any Wire Combination Wires may be in plate form.

Paper may be compressed between the two wires.

Thickness of paper or wood materials can be in between 0.1 mm to 2 mm.

h) Alternative Types of Activation Components

Activation component (33) can be made by mixing Ni—C, Metal-Glasspowder with carbon as well as carbon.

Activation component (33) can be 100% carbon.

Additional Properties of Activation Component (33);

The activation components can be used more than a single line, in series and/or in parallel.

Prepared alloy(s) can be covered with ceramic, plastic, and/or silicon.

Activation component (33) can have electrical polarity.

Activation Components specified above can be more than one and with different features in a mixture Activation component (33) may have a shield like a film layer, composed of ceramic, plastic, and/or glass alloys to prevent chemical compound/mixture embedded inside, from decomposing and diffusing.

The activation component (33) developed in this invention can activate any explosive or non-explosive chemicals or similar systems.

Part (C)—Activation System (39) (Mobile Units (2), Main Unit (35)) with all Hardware, Software and Related Details.

Activation system (39) consisting mobile units (2), main unit (35) is the part of the system which activates activation component (33). Activation system (39) comprises;

Main Unit Control Panel (1),
Mobile Unit (2)
Connectors for Activation components (3)
Mobile Unit Connection Socket (4)
Line Power Connector (5)
Main Unit Connection Socket (6)
Mobile Unit Control Panel (7)
Connection cable; Main Unit to Mobile Units (8)
Service Box (Fuse, Breakers, Power Drivers) (9)
Solar Panel (10)
Main Unit Control Panel Display (11)
Navigation Buttons (12)
USB Socket (13)
Ethernet Socket (14)
Emergency Button (15)
Keypad (16)
Activation Buttons (17)
Places for Transport Hooks (18)
Parking wheel (19)
Trailer Hitch (20)
Computer (21)
External Power Supply (22)
Charge Unit (23)
Telecommunication Unit (24)
Circuit Breakers (25)
Batteries (26)
Main Control Unit (27)
Mobil Unit Control Buttons (28)
Mini Control Panel and Display (29)
Activation component wires (30)
Main Unit (Activation System) (35)
Mobile Unit Cabinet Door (36)
Control Panel Cabinet Door (37)
Software
Telecommunication Unit (GPS, GPRS Modules)
Distributors The rock and concrete breaking (fracturing-demolishing-splitting) system as claimed in any of the preceding Claims and characterized in that activation system (39) (mobile unit, main unit) comprises at least;

Batteries (26) and/or solar panel (10) and/or generator and/or line voltage (110~380 Volts, AC or DC) (Power supply)

Cables/wires (8, 30),

Control unit (processor) or computer (21),

Activation system (39) can be two different types;

Single Unit,

Separate main unit (35) and mobile units (2), at least one main unit (35) and one or more mobile units (2) communicating with the main unit (35).

Single Unit Activation System (39)

System equipment and their functions can be integrated in a single unit.

System is directly connected to activation component wires (30).

All power and control equipment and components are placed in this unit.

This single unit can be designed to perform pre-determined functions of main unit as well as can have all functions of main unit (35).

This single unit can produced as main unit (35).

This unit can be manufactured in smaller size to carry in hand and/or a hand-held instrument.

Separate Main Unit (35) and Mobile Units (2) System

There is at least one main unit 35) and at least one mobile unit (2) connected to and in communication with main unit (35).

Activation can be performed by main unit (35), and mobile unit (2) can be used for intermediate connection point.

Activation can be performed by mobile unit (2).

During connecting one mobile unit (2) to activation components, main unit (35) can perform activation independently with another mobile unit (2) at a different point.

By this way, system makes possible performing activations at a point while continuing activation preparations at another point.

Activation System (39) can Contain Features Below However; not Limited with these Features.

Mobile Unit (2) alone or main unit (35) and mobile units (2) together (in combined form) can be in different width, height and depth dimensions.

As the Power Supply

For power supply, (batteries (26) or any external DC or AC power supplies (22)) having range of 100 mA and 15000 A current and 1 V and 60000 V voltages are used.

All types of batteries (26) can be used, like; dry and lead cell,

Batteries (26) with Ni, Ag and Pb can be used.

Batteries (26) are placed in main unit.

Transformers having input range 1 phase 110 Volts and 3 phase 220~380 Volts may be used as power supply, Transformers having output range 0.1 volts and 60000 Volts may be used as power supply, Generators having output range 0.1 Volts and 60000 Volts may be used as power supply, Cables (8) and Wires (30)

Cross section of cables/wires (8, 30) can be between 0.1 mm2 and 50 mm2.

Cables/wires (8, 30) can be insulated with different materials on the copper wires.

Cables/wires (8, 30) can be without insulation material.

Metal surface of cables//wires (8, 30) can be dyed with any kind of paint.

Activation system (39) comprises special software to receive the input data and controls the activation components (33) for activating the system.

INDUSTRIAL APPLICATION OF THE INVENTION

The present invention can be applied in several areas where there is a requirement to break and split rock and concrete, as:

road construction excavation at housing sites bridge demolition and renovation mass excavation of rock dimension stone quarries boulder breaking trenching in rock & hard materials tunneling and shaft sinking underwater excavation of rock and concrete concrete and reinforced concrete breaking and demolition blocked and clogged silo cleaning and rathole opening interior demolition of rock and concrete breaking—demolition and excavation of all types of hard formations and structures excavation of all types of ground and soil and earth structures.

How System Works

The method of using the "rock and concrete breaking (demolition-fracturing-splitting) system" developed by this inventions is generally explained below.

1. Drill the holes in the rock (32) considering the requirements of breaking. The diameter of the holes should be in consistent with the length of the hole, the rock sizes, amount and sizes to break, depth of the rock, chemical mixture (34) necessary per hole.
2. Pour the chemical mixture (34) to the bottom of the hole. Preferably; it is advised to pour about half of the chemical mixture (34) that should be placed inside the hole.
3. Then, place the activation component (33), taking care about the wire couples (30) that their ends should be on the ground (38).
4. Pour the rest of the chemical mixture (34) inside the hole.
5. Start stemming (31) above the chemical mixture (34); using the native materials and clay, soil, lime, etc. Try to use fine materials instead of very coarse type and avoid dropping small stones in the hole.
6. During stemming (31), in order to keep the chemical mixture (34) under sufficient pressure, tamp the stemming materials at certain intervals by a suitable stick.
7. Do the same for each hole carefully avoiding any damage to the wires (30) and activation components (33).
8. Connect the wire couples (30) coming from the activation components (33) to the connectors (3) on the mobile unit (2).
9. Check the system and connections from the control buttons (28) and mini control panel and display (29) on the mobile unit (2).
10. When this part of the preparations is completed, connect the mobile unit (2) to the main unit (35) by plugging the connection cable (8) from the main unit (35) to the connection socket (4) on the mobile unit (2).
11. Make all system settings according to the breaking patterns from the main unit control panel (1). All these settings, controls, adjustments, schedule of activations, etc. are done from the main unit control (1) panel and buttons on the panel; navigation buttons (12), keypad (16).
12. Before starting the demolition and breaking stage, check the excavation area to avoid any sort of accident or mistake. Warn the people to be away from the excavation area at a reasonable distance to avoid any accident or injury.
13. When all these steps are completed, press the activation buttons (17) to start the activation duration.
14. When the activation button is pressed, depending on the settings (start, delay, sequential, etc.) the current from the main unit (35) is released and via the mobile unit (2) and wires (30), it is transferred to the activation components (33). This power lets the activation components (33) get activated and by the effect of supply power (current/voltage), it flashes and starts burning very rapidly.
15. The sudden flash and flame from the activation component (33) burns the chemical mixture (34) in a very short time.

16. This very sudden reaction lets the chemical mixture (34) to change phase from solid form to gas form.
17. This very sudden phase change creates a high pressure inside the rock (32) and the resulting gas tries to escape from the tiny cracks inside the rock (32), thus leading to the fracturing of the rock (32).
18. Following these operations, check all results and data after the activation from the control panel display (11). Remove all instruments and equipment from the excavation zone. Check the broken rock (32) and start the next stage.

The invention claimed is:

1. A rock and concrete breaking (fracturing-demolishing-splitting) system comprising:

a chemical mixture comprising potassium chlorate with ratio of 55-70% by weight of mixture; ammonium oxalate with ratio of 15-30% by weight of mixture; sugar or lactose or starch or any combination of them with ratio of 15-20% by weight of mixture; boron oxide (boroxide) ($B_2O_3$) with ratio of 5-10% by weight of mixture; borax decahydrate ($Na_2B_4O_7.10H_2O$) with ratio of 3-5% by weight of mixture;

an activation component placed inside and/or in contact directly or indirectly with the chemical mixture, wherein the activation component is configured to activate the chemical mixture to burn and expand; and an activation system configured to activate the activation component wherein when the activation system activates the activation component, the activation component activates the chemical mixture that causes chemical mixture to burn and expand.

2. The system of claim 1, wherein the activation system further comprises a hardware, the hardware comprises at least one mobile unit and a main unit.

3. The system of claim 1, wherein the activation system further comprises a software to receive an input data and control the activation component.

4. The system of claim 1, wherein the activation system is configured to produce 0.1-100 V voltage, and 100 umA-5000 A current under AC or DC voltage.

5. The system of claim 1, wherein the activation component is selected from a group consisting of metal oxide based activation components, silicium or germanium based activation components, diode or zener diode based activation components, resistors based activation components, Cu, Al, Ag, Au, or Pt wire based activation components, capacitors based activation components, and paper or wood materials based activation components.

6. The system of claim 1, wherein the activation component comprises metal oxide varistors.

* * * * *